United States Patent [19]

Avidan et al.

[11] Patent Number: 4,966,680

[45] Date of Patent: Oct. 30, 1990

[54] INTEGRATED CATALYTIC CRACKING PROCESS WITH LIGHT OLEFIN UPGRADING

[75] Inventors: Amos A. Avidan, Yardley; Sergei Yurchak, Media, both of Pa.

[73] Assignee: Mobil Oil Corporation, New York, N.Y.

[21] Appl. No.: 200,109

[22] Filed: May 31, 1988

[51] Int. Cl.[5] ..... C10G 57/02

[52] U.S. Cl. ..... 208/71; 208/49; 208/113; 208/70; 585/322; 585/330; 585/533

[58] Field of Search ..... 208/120, 71, 155, 70, 208/74, 49, 113; 585/322, 519, 520, 330

[56] References Cited

U.S. PATENT DOCUMENTS

| | | | |
|---|---|---|---|
| 3,856,659 | 12/1974 | Owen | 208/155 |
| 3,907,663 | 9/1975 | Owen | 208/70 |
| 4,012,455 | 3/1977 | Owen et al. | 260/668 |
| 4,433,185 | 2/1984 | Tabak | 585/322 |
| 4,456,779 | 6/1984 | Owen et al. | 585/322 |
| 4,497,968 | 2/1985 | Wright et al. | 585/415 |
| 4,541,923 | 9/1985 | Lomas et al. | 208/120 |
| 4,560,536 | 12/1985 | Tabak | 208/70 |
| 4,639,308 | 1/1987 | Lee | 208/100 |
| 4,675,099 | 6/1987 | Skraba | 208/157 |
| 4,681,743 | 7/1987 | Skraba | 422/140 |
| 4,717,466 | 1/1988 | Herbst et al. | 208/74 |

*Primary Examiner*—Anthony McFarlane

*Attorney, Agent, or Firm*—Alexander J. McKillop; Charles J. Speciale; L. G. Wise

[57] ABSTRACT

Process and apparatus for upgrading light olefinic crackate gas from a fluidized catalytic cracking unit having a riser reactor for contacting hot solid cracking catalyst with a heavy hydrocarbon feedstock, said light crackate gas containing ethene, propene and other $C_1$–$C_4$ lower aliphatics, comprising the steps of:

reacting the light olefinic gas in contact with a fluidized bed of acid medium pore zeolite catalyst particles under oligomerization and/or aromatization conditions to produce a hydrocarbon effluent stream rich in $C_5$+ hydrocarbons and a byproduct light gas rich in $C_1$–$C_4$ saturated hydrocarbons;

separating the oligomerization reaction effluent stream to provide a second light gas stream and a condensed liquid hydrocarbon product stream; and recycling at least a portion of the second gas stream to the fluidized catalytic cracking unit as a lift gas for fluidizing solid cracking catalyst particles in a lower riser portion of said cracking unit.

8 Claims, 2 Drawing Sheets

INTEGRATED CATALYTIC CRACKING PROCESS WITH LIGHT OLEFIN UPGRADING

FIELD OF THE INVENTION

This invention relates to a technique for integrating catalytic cracking of heavy hydrocarbon oils with an olefins upgrading process for the catalytic conversion of light olefinic cracking gases to produce liquid hydrocarbons boiling in the gasoline and distillate range.

BACKGROUND OF THE INVENTION

Hydrocarbon mixtures containing significant quantities of light olefins are frequently encountered in petroleum refineries, particularly as a byproduct of fluidized catalytic cracking (FCC) processes. Because of the ease with which olefins react, these streams serve as intermediate feedstocks in a variety of hydrocarbon conversion processes. Many olefinic conversion processes require that the olefinic feed be provided in a highly purified condition. However, processes which may utilize the olefinic feedstocks without the need for further separation and purification are highly desirable.

Although the main purpose of fluidized catalytic cracking is to convert gas oils to compounds of lower molecular weight in the gasoline and middle distillate boiling ranges, significant quantities of $C_1$-$C_4$ hydrocarbons are also produced. These light hydrocarbon gases are rich in olefins, which are useful for conversion to gasoline blending stocks by means of polymerization and/or alkylation.

Fractionation of effluent from the fluid catalytic cracking reactor has been employed to effect an initial separation of this stream. The gaseous overhead from the main fractionator is collected and processed in the FCC unsaturated gas plant (USGP). Typically, the gases are compressed, contacted with a naphtha stream, scrubbed with an amine solution to remove acidic sulfur components, and then fractionated to provide light olefins and isobutane for alkylation, light olefins for polymerization, n-butane for gasoline blending and propane for LPG. Ethane and other light gases are usually recovered for use as fuel.

Since alkylation units were more costly to build and operate than polymerization units, olefin polymerization was initially favored as the route for providing blending stocks. Increased gasoline demand and rising octane requirements soon favored the use of alkylation because it provided gasoline blending stocks at a higher yield and with a higher octane rating than the comparable polymerized product. However, catalytic alkylation can present some safety and disposal problems. In addition, feedstock purification is required to prevent catalyst contamination and excess catalyst comsumption. Further, sometimes there is insufficient isobutane available in a refinery to permit all the $C_3$-$C_4$ olefins from the FCC to be catalytically alkylated.

Conversion of olefins to gasoline and/or distillate products is disclosed in U.S. Pat. Nos. 3,960,978 and 4,021,502 (Givens, Plank and Rosinski) wherein gaseous olefins in the range of ethylene to pentene, either alone or in admixture with paraffins are converted into an olefinic gasoline blending stock by contacting the olefins with a catalyst bed made up of ZSM-5 or related zeolite. In U.S. Pat. Nos. 4,150,062 and 4,227,992 Garwood et al disclose the operating conditions for the Mobil Olefin to Gasoline/Distillate (MOGD) process for selective conversion of $C_3$+ olefins. An economic fluid bed process, sometimes known as MOG, is especially useful in upgrading mixed light gas feedstreams containing olefins in mixture with other FCC light cracking gas components. The MOG process is disclosed by Avidan et al in U.S. Pat. application Ser. No. 006,407, filed 23 Jan 1988, incorporated herein by reference.

The process for catalytic conversion of olefins to heavier hydrocarbons by catalytic oligomerization reaction may be followed by other reactions, such as cyclization to form aromatics. Using an acid crystalline metallosilicate zeolite, such as ZSM-5 or related shape-selective catalyst, process conditions can be varied to favor the formation of either gasoline or distillate range products. In a preferred fluidized bed gasoline operating mode reactor system, ethylene and the other lower olefins are catalytically oligomerized at elevated temperature and moderate pressure. Under these conditions ethylene conversion rate is greatly increased and lower olefin oligomerization is nearly complete to produce an olefinic gasoline comprising hexene, heptene, octene and other $C_5$+ hydrocarbons in good yield. Other $C_5$+ products include aromatics, naphthenes and paraffins. Such a conversion unit has a significant alkane-rich $C_1$-$C_4$- aliphatic hydrocarbon byproduct, comprising n-butanes, i-butanes, propane, ethane and minor amounts of unreacted lower olefins.

U. S. Pat. Nos. 4,012,455 and 4,090,949 (Owen and Venuto) and published European Patent Application No. 0,113,180 (Graven and McGovern) disclose integration of olefins upgrading with a typical FCC plant. In the EPA application the olefin feedstock for MOGD comprises the discharge stream from the final stage of the wet gas compressor or the overhead from the high pressure receiver which separates the condensed effluent from the final stage wet gas compressor contained in the gas plant. The present invention improves upon such integrated processes by incorporating olefins upgrading advantageously with the FCC reactor and gas plant, providing a novel use for alkane-rich byproduct of the olefin upgrading unit.

SUMMARY OF THE INVENTION

A novel fluid catalytic cracking technique has been found for admixing a hydrocarbon oil feed with hot regenerated catalyst in a bottom portion of a reactor riser with a light hydrocarbon lift gas. The FCC reactor system operates in a conventional manner by passing the mixture of the hydrocarbon oil feedstock, catalyst and lift gas through the riser, thereby volatilizing the oil feed and effecting cracking thereof at the process temperature under endothermic process conditions and deactivating the catalyst by deposition of carbonaceous deposits thereon, separating the deactivated catalyst from the cracked hydrocarbonaceous feed, passing the deactivated catalyst to a regenerator vessel wherein the carbonaceous deposits are removed from the deactivated catalyst under exothermic process conditions by means of a regenerating medium introduced into the regenerator vessel, and passing the regenerated hot catalyst substantially above process cracking temperature to the bottom section of the reactor riser.

The improvement herein comprises methods and means for:

separating and recovering cracked liquid hydrocarbons in a main fractionator to separate effluent from catalytic cracking of hydrocarbon feedstock to provide liquid cracking product and a light gas stream comprising $C_2$-$C_4$ olefinic and paraffinic gases;

contacting the olefin-containing gases in an olefin upgrading reactor with a fluidized bed of medium pore zeolite oligomerization catalyst particles under oligomerization reaction conditions conditions to convert said olefins to gasoline range hydrocarbons and a $C_4$-byproduct gas stream rich in saturated hydrocarbons; and;

passing at least a portion of said byproduct saturated gas stream to the bottom of the cracking reactor riser as a lift gas.

DETAILED DESCRIPTION OF THE INVENTION

FCC Operations

Figure 1:
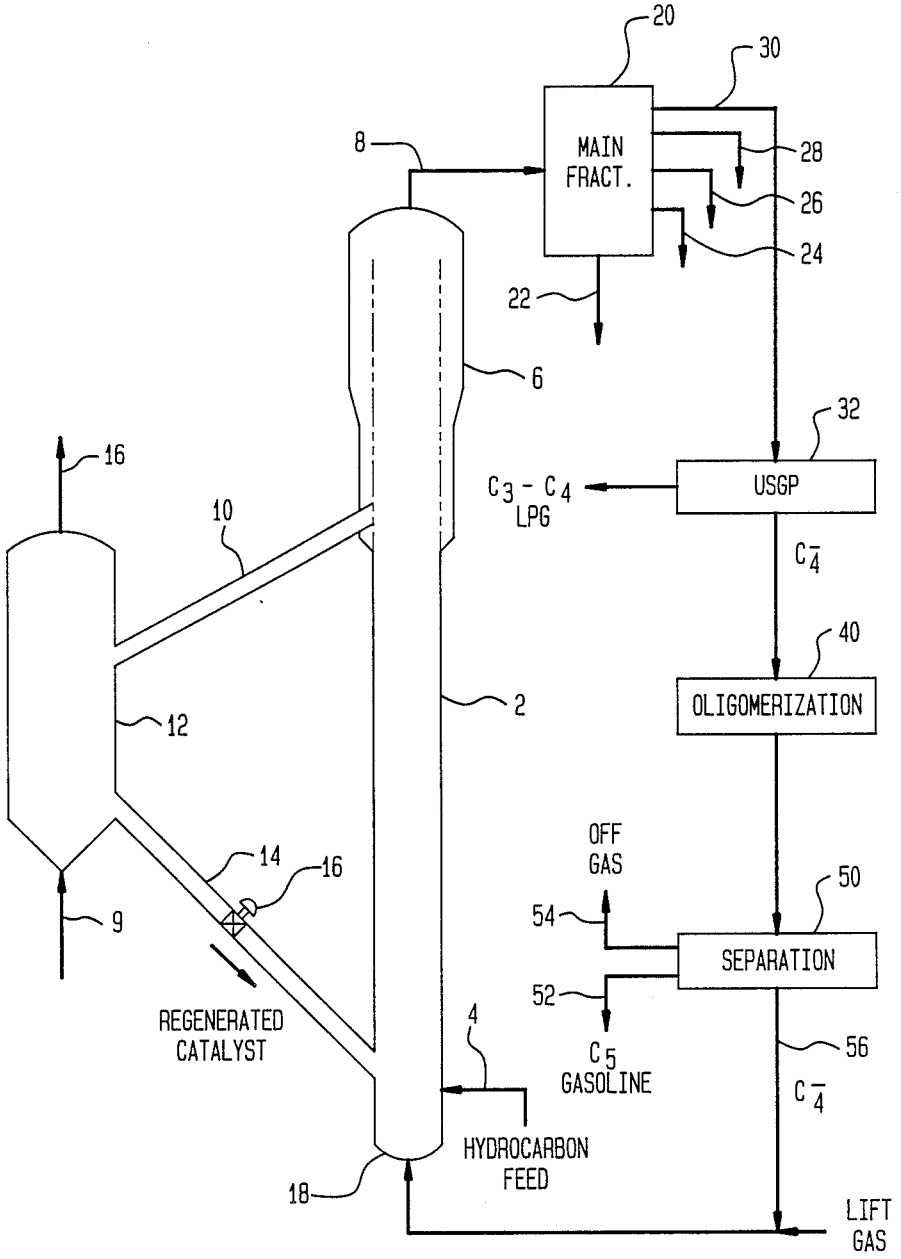
FIG. 1 is a schematic diagram of a vertical FCC reactor and regenerator system, including an improved light crackate gas upgrading unit, and separation units for recovering FCC products and oligomerization effluent streams.

Conversion of various petroleum fractions to more valuable products in catalytic reactors is well known in the refining industry, where the use of FCC reactors is particularly advantageous for that purpose. The FCC reactor typically comprises a thermally balanced assembly of apparatus comprising the reactor vessel containing a mixture of regenerated catalyst and the feed and regenerator vessel wherein spent catalyst is regenerated. The feed is converted in the reactor vessel over the catalyst, and carbonaceous deposits simultaneously form on the catalyst, thereby deactivating it. The deactivated (spent) catalyst is removed from the reactor vessel and conducted to the regenerator vessel, wherein coke is burned off the catalyst with air, thereby regenerating the catalyst. The regenerated catalyst is then recycled to the reactor vessel. The reactor-regenerator assembly must be maintained in steady state heat balance, so that the heat generated by burning the coke provides sufficient thermal energy for catalytic cracking in the reactor vessel. The steady state heat balance is usually achieved and maintained in FCC reactors by controlling the rate of flow of the regenerated catalyst from the regenerator to the reactor by means of an adjustable slide valve in the regenerator-to-reactor conduit.

Typically, the product stream of the catalytic cracker is fractionated into a series of products, including gas, gasoline, light gas oil, and heavy cycle gas oil. A portion of the heavy cycle gas oil is usually recycled into the reactor vessel and mixed with fresh feed. The bottom effluent of the fractionator is conventionally subjected to settling and the solid-rich portion of the settled product may be recycled to the reactor vessel in admixture with the heavy cycle gas oil and feed.

In a modern FCC reactor, the regenerated catalyst is introduced into the base of a riser reactor column in the reactor vesel. A primary purpose of the riser reactor is to crack the petroleum feed. The regenerated hot catalyst is admixed in the bottom of the riser reactor with a stream of fresh feed and recycled petroleum fractions, and the mixture is forced upwardly through the riser reactor. It is often advantageous to facilitate the fluidization of the solid catalyst particles and mixing with the feedstock liquids by empolying a lift gas. During the upward passage of the catalyst and of the petroleum fractions, the petroleum is cracked, and coke is simultaneously deposited on the catalyst. The coked catalyst and the cracked petroleum components are passed upwardly out of the riser and through a solid-gas separation system, e.g., a series of cyclones, at the top of the reactor vessel. The cracked petroleum fraction is conducted to product separation, while the coked catalyst, after steam stripping, passes into the regenerator vessel and is regenerated therein, as discussed above. Most of the cracking reactions in such modern FCC units take place in the riser reactor. Accordingly, the remainder of the reactor vessel is used primarily to separate entrained catalyst particles from the petroleum fractions.

Further details of FCC processes can be found in: U.S. Pat. Nos. 3,152,065 (Sharp et al); 3,261,776 (Banman et al); 3,654,140 (Griffel et al); 3,812,029 (Snyder); 4,093,537, 4,118,337, 4,118,338, 4,218,306 (Gross et al); 4,444,722 (Owen); 4,459,203 (Beech et al); 4,639,308 (Lee); 4,675,099, 4,681,743 (Skraba) as well as in Venuto et al, Fluid Catalytic Cracking With Zeolite Catalysts, Marcel Dekker, Inc. (1979). The entire contents of all of the above patents and publications are incorporated herein by reference.

Conventional large pore zeolite solid FCC catalyst may be used in the reactor utilizing the process. Particularly useful are finely divided acidic zeolites, preferably low coke-producing crystalline zeolite cracking catalysts comprising faujasite, crystalline REY zeolites and other large pore zeolites known in the art. Typically, the catalyst is a fine particle having an average size of about 20 to 100 microns.

In FCC cracking hot catalyst (650° C.+) is mixed with relatively cold (150–375° C.) charge stock. The catalyst is the heat transfer medium for vaporizing and superheating the oil vapor to a temperature suitable for the desired cracking reaction (480–545° C.). In the initial stage of mixing oil and catalyst, some oil is inevitably heated to a temperature approaching that of the hot catalyst with consequent overcracking, creating a large increase in gas make. Coking of the catalyst is particularly heavy when the hot catalyst contacts oil in the liquid phase above cracking temperature. It is an object of the present invention to employ a lift gas stream to control the initial mixing so as to minimize localized overheating and decrease coking.

The decrease of coking by lift gas is thought to proceed by a combination of at least three mechanisms: (1) Pre-acceleration of catalyst improves oil-catalyst contact at the oil injection level; (2) $H_2S$ present in the lift gas reduces metal activity of the catalyst; (3) Paraffins may have a similar effect to $H_2S$. It is known that the introduction of olefinic lift gas is undesirable, as olefins tend to increase coke yield, intead of decreasing it.

The improvement herein comprises a novel technique for continuously injecting liquid oil feed into a primary mixing zone in a riser mixing zone with a novel source of lift gas derived from an olefin upgrading unit wherein lower aliphatic crackate is converted catalytically to heavier liquid hydrocarbons and byproduct light gas stream rich in saturates and suitable for use as lift gas in the FCC mixing zone..

In a preferred embodiment an improved FCC reactor system and crackate upgrading unit is provided for fluidized bed catalytic cracking comprising a vertical riser operatively connected to receive hot regenerated catalyst from a regeneration loop; means for feeding liquid oil under pressure to the bottom inlet thereof; mixing means for combining solid cracking catalyst from the regeneration loop with liquid feed oil in a mixing chamber having lift gas inlet means adjacent a catalyst riser inlet conduit at the bottom of the riser, the mixing chamber being operatively mounted in the riser.

In general, this invention can be utilized with conventional FCC reactors, such as those disclosed in the references set forth above. Similarly, the process of this invention can also be utilized with various cracking feeds, such as napthas, gas oils, vacuum gas oils, residual oils, light and heavy distillates and synthetic fuels.

In reference to FIG. 1, representing a schematic flow diagram of an exemplary FCC unit, a hydrocarbon feed is introduced near the bottom of the riser reactor 2 via inlet means 4. Hot regenerated catalyst is also introduced to the bottom of the riser by a standpipe supply conduit 14, usually equipped with a flow control valve 16. A lift gas is introduced near the liquid and solid feed inlets via conduit 18. The reactor riser usually comprises an elongated cylindrical smooth-walled tubular portion. The portion of the FCC reactor riser betwen lift gas inlet 18 and feed oil inlet 4 is typically narrower than subsequent portions of the riser. This facilitates achieving a high lift velocity with less lift gas. The length of this riser acceleration section can be about 1 to 15 meters, and the FCC feed would ordinarily be introduced above this acceleration section through several concentric nozzle pipes (not shown). The pipes enter the riser tangentially, for instance at an angle of 45 to 70° from the horizontal, and dishcarge liquid upwardly. Various atomizing devices may be employed, and such liquid handling means can be mounted on the feed nozzle pipes.

The liquid feed volatilizes and it forms a suspension with the pre-accererated solid catalyst which proceeds upwardly in the vertical reactor riser. The suspension formed in the lower section of the riser is passed upwardly through the riser under selected temperature and residence time conditions. The suspension passes into a generally wider section of the reactor 6 which contains solid-vapor separation means, such as a conventional cyclone, and means for stripping entrained hydrocarbons from the catalyst. Neither the stripping section, nor the solid-gas separation equipment is shown in the drawing for clarity. Such equipment is that conventionally used in catalytic cracking operations of this kind and its construction and operation, it is believed, will be apparent to those skilled in the art. The vapor separated in the cyclone and in the stripping means, including diluent vapor, is withdrawn from the reactor by a conduit 8.

Stripped catalyst containing carbonaceous deposits or coke is withdrawn from the bottom of the stripping section through a conduit 10 and conducted to a regeneration zone in vessel 12. In the regeneration zone the catalyst is regenerated by passing an oxygen-containing gas, such as air, through a conduit 9, burning the coke off the catalyst in a regenerator 12 and withdrawing the flue gasses from the regenerator by a conduit 16. Advantageously, the feedstock comprises a petroleum oil fraction at a feed temperature of about 150° C. to 375° C., the hot regenerated catalyst is from the regenerator vessel at about 650° C. to 725° C., resulting in an average process cracking temperature of about 480° C. to 535° C. The weight ratio of total catalyst to feed is usually about 4:1 to 8:1.

Cracked hydrocarbon product from the FCC unit passes from outlet 8 to a main fractionator unit 20, where the FCC effluent is separated into a heavy bottoms stream 22, heavy distillate 24, light distillate 26, naphtha 28, and a light overhead stream 30, rich in C2-C4 olefins, C1-C4 saturates, and other light crackage gas components. This stream is usually treated in an unsaturated gas plant 32 to recover various light gas streams, including C3-C4 LPG, and optionally $C_2$- fuel gas or the like. The present invention provides a subsystem 40 for upgrading FCC light olefins to liquid hydrocarbons, utilizing a continuous catalytic process for producing fuel products by oligomerizing olefinic components to produce olefinic product for use as fuel or the like. It provides a technique for oligomerizing lower alkene-containing light gas, optionally containing ethene, propene, butenes or lower alkanes, to produce predominantly $C_5$+ hydrocarbons, including olefins. The effluent from upgrading unit 40, rich in gasoline and $C_4$- saturated hyrocarbon byproduct is passed to separation unit 50 for recovery of a liquid gasoline product stream 52, light gas recovery stream 54 and a recycle stream 56, which contains predominantly C3-C4 alkanes, and a minor amount of unreacted C2-C4 olefins. This stream may be combined with fresh makeup gas and passed under suitable conditions of temperature and pressure to the bottom inlet of reactor 2 via inlet 18.

Olefin Upgrading Operations

The preferred feedstream to the olefins upgrading unit contains $C_2$-$C_4$ alkenes (mono-olefin), wherein the total $C_3$-$C_4$ alkenes are in the range of about 10 to 50 wt%. Non-deleterious components, such as methane and other paraffins and inert gases, may be present. A particularly useful feedstream is a light gas by-product of FCC gas oil cracking units containing typically 10–40 mol % $C_2$-$C_4$ olefins and 5–35 mol % $H_2$ with varying amounts of C1-C3 paraffins and inert gas, such as $N_2$. The process may be tolerant of a wide range of lower alkanes, from 0 to 95%. Preferred feedstocks contain more than 50 wt. % $C_1$-$C_4$ lower aliphatic hydrocarbons, and contain sufficient olefins to provide total olefinic partial pressure of at least 50 kPa. Under the reaction severity conditions employed in the present invention lower alkanes especially propane, may be partially converted to $C_4$+ products.

Conversion of lower olefins, especially ethene, propene and butenes, over HZSM-5 is effective at moderately elevated temperatures and pressures. The conversion products are sought as liquid fuels, especially the $C_5$+ hydrocarbons. Product distribution for liquid hydrocarbons can be varied by controlling process conditions, such as temperature, pressure and space velocity. Gasoline (eg, $C_5$-$C_9$) is readily formed at elevated temperature (e.g., up to about 510° C.) and moderate pressure from ambient to about 5500 kPa, preferably about 250 to 2900 kPa. Under appropriate conditions of catalyst activity, reaction temperature and space velocity, predominantly olefinic gasoline can be produced in good yield and may be recovered as a product. Operating details for typical olefin oligomerization units are disclosed in U S. Pat. Nos. 4,456,779; 4,497,968 (Owen et al.) and 4,433,185 (Tabak), incorporated herein by reference.

It has been found that $C_2$-$C_4$ rich olefinic light gas can be upgraded to liquid hydrocarbons rich in olefinic gasoline by catalytic conversion in a turbulent fluidized bed of solid acid zeolite catalyst under low severity reaction conditions in a single pass or with recycle of gaseous effluent components. This technique is particularly useful for upgrading LPG and FCC light gas, which usually contains significant amounts of ethene, propene, butenes, $C_1$-$C_4$ paraffins and hydrogen produced in cracking heavy petroleum oils or the like. It is a primary object of the present invention to provide a novel technique for upgrading such lower olefinic feedstock to distillate and gasoline range hydrocarbons in an economic multistage reactor system.

Olefin Upgrading Catalyst

Recent developments in zeolite technology have provided a group of medium pore siliceous materials having similar pore geometry. Most prominent among these intermediate pore size zeolites is ZSM-5, which is usually synthesized with Bronsted acid active sites by incorporating a tetrahedrally coordinated metal, such as Al, Ga, or Fe, within the zeolytic framework. These medium pore zeolites are favored for acid catalysis; however, the advantages of ZSM-5 structures may be utilized by employing highly siliceous materials or cystalline metallosilicate having one or more tetrahedral species having varying degrees of acidity. ZSM-5 crystalline structure is readily recognized by its X-ray diffraction pattern, which is described in U.S. Pat. No. 3,702,866 (Argauer, et al.), incorporated by reference.

The oligomerization catalyst preferred for use in olefins conversion includes the medium pore (i.e., about 5–7 angstroms) shape selective crystalline aluminosilicate zeolites having a silica to alumina ratio of about 20:1 or greater, a constraint index of about 1–12, and acid cracking activity (alpha value) of about 2–200. Representative of the shape selective zeolites are ZSM-5, ZSM-11, ZSM-12, ZSM-22, ZSM-23, ZSM-35, and ZSM-48. ZSM-5 is disclosed in U.S. Pat. No. 3,702,886 and U.S. Pat. No. Reissue 29,948. Other suitable zeolites are disclosed in U.S. Pat. Nos. 3,709,979 (ZSM-11); 3,832,449 (ZSM-12); 4,076,979; 4,076,842 (ZSM-23); 4,016,245 (ZSM-35); and 4,375,573 (ZSM-48). The disclosures of these patents are incorporated herein by reference.

While suitable zeolites having a silica to coordinated metal oxide molar ratio of 20:1 to 200:1 or higher may be used, it is advantageous to employ a standard ZSM-5 having a silica alumina molar ratio of about 25:1 to 70:1, suitably modified. A typical zeolite catalyst component having Bronsted acid sites may consist essentially of aluminosilicate ZSM-5 zeolite with 5 to 95 wt.% silica clay and/or alumina binder.

These siliceous zeolites may be employed in their acid forms ion exchanged or impregnated with one or more suitable metals, such as Ga, Pd, Zn, Ni, Co and/or other metals of Periodic Groups III to VIII. Ni-exchanged or impregnated catalyst is particularly useful in converting ethene under low severity conditions. The zeolite may include other components, generally one or more metals of group IB, IIB, IIIB, VA, VIA or VIIIA of the Periodic Table (IUPAC). Useful hydrogenation-dehydrogenation components include the noble metals of Group VIIIA, especially platinum, but other noble metals, such as palladium, gold, silver, rhenium or rhodium, may also be used. Base metal hydrogenation components may also be used, especially nickel, cobalt, molybdenum, tungsten, copper or zinc. The catalyst materials may include two or more catalytic components, such as a metallic oligomerization component (eg, ionic $Ni^{+2}$, and a shape-selective medium pore acidic oligomerization catalyst, such as ZSM-5 zeolite) which components may be present in admixture or combined in a unitary bifunctional solid particle. It is possible to utilize an ethene dimerization metal or oligomerization agent to effectively convert feedstock ethene in a continuous reaction zone. Certain of the ZSM-5 type medium pore shape selective catalysts are sometimes known as pentasils. In addition to the preferred aluminosilicates, the gallosilicate, borosilicate, ferrosilicate and "silicalite" materials may be employed.

ZSM-5 type pentasil zeolites are particularly useful in the process because of their regenerability, long life and stability under the extreme conditions of operation. Usually the zeolite crystals have a crystal size from about 0.01 to over 2 microns or more, with 0.02–1 micron being preferred.

A further useful catalyst is a medium pore shape selective crystalline aluminosilicate zeolite as described above containing at least one Group VIII metal, for example Ni-ZSM-5. This catalyst has been shown to convert ethylene at moderate temperatures and is disclosed by Garwood et al in U.S. Pat. No. 4,717,782, incorporated herein by reference.

Fluidized Bed Reactor Operation

Figure 2:
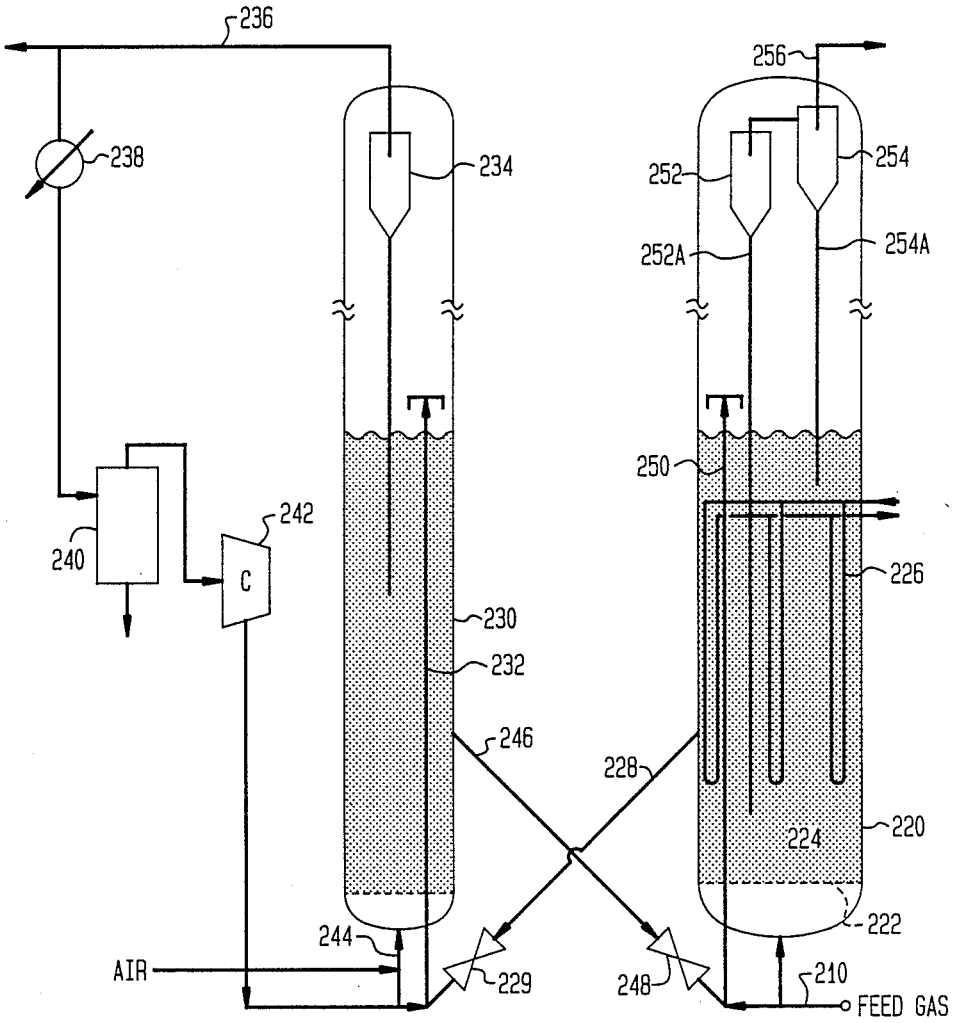
FIG. 2 is a vertical cross-section view of a preferred fluidized bed oligomerization reactor system according to the present invention.

Referring to FIG. 2 of the drawing, a typical MOG type oligomerization reactor unit is depicted employing a temperature-controlled catalyst zone with indirect heat exchange and/or adjustable gas quench, whereby the reaction exotherm can be carefully controlled to prevent excessive temperature above the usual operating range of about 260° C. to 510° C., preferably at average reactor temperature of 315° C. to 400° C. Energy conservation in the system may utilize at least a portion of the reactor exotherm heat value by exchanging hot reactor effluent with feedstock and/or recycle streams. Optional heat exchangers may recover heat from the effluent stream prior to fractionation. Part of all of the reaction heat can be removed from the reactor without using the indirect heat exchange tubes by using cold feed, whereby reactor temperature can be controlled by adjusting feed temperature. The internal heat exchange tubes can still be used as internal baffles which lower reactor hydraulic diameter, and axial and radial mixing The use of a fluid-bed reactor offers several advantages over a fixed-bed reactor. Due to continuous catalyst regeneration, fluid-bed reactor operation will not be adversely affected by oxygenate, sulfur and/or nitrogen containing contaminants presented in FCC light gas.

Particle size distribution can be a significant factor in achieving overall homogeneity in turbulent regime fluidization. It is desired to operate the process with particles that will mix well throughout the bed. Large particles having a particle size greater than 250 microns should be avoided, and it is advantageous to employ a particle size range consisting essentially of 1 to 150 microns. Average particle size is usually about 20 to 100 microns, preferably 40 to 80 microns. Particle distribution may be enhanced by having a mixture of larger and smaller particles within the operative range, and it is particularly desirable to have a significant amount of fines. Close control of distribution can be maintained to keep about 10 to 25 wt % of the total catalyst in the reaction zone in the size range less than 32 microns. This class of fluidizable particles is classified as Geldart Group A. Accordingly, the fluidization regime is controlled to assure operation between the transition velocity and transport velocity. Fluidization conditions are substantially different from those found in non-turbulent dense beds or transport beds.

The oligomerization reaction severity conditions can be controlled to optimize yield of $C_5$-$C_9$ aliphatic hydrocarbons. It is understood that aromatic and light paraffin production is promoted by those zeolite catalysts having a high concentration of Bronsted acid reaction sites. Accordingly, an important criterion is selecting and maintaining catalyst inventory to provide either fresh catalyst having acid activity or by controlling catalyst deactivation and regeneration rates to provide an average alpha value of about 2 to 50, based on total catalyst solids.

Reaction temperatures and contact time are also significant factors in determining the reaction severity, and the process parameters are followed to give a substantially steady state condition wherein the reaction severity index (R.I.) is maintained within the limits which yield a desired weight ratio of alkane to alkene produced in the reaction zone. This index may vary from about 0.1 to 7:1, in the substantial absence of C3+ alkanes; but, it is preferred to operate the steady state fluidized bed unit to hold the R.I. at about 0.2 to 5:1. While reaction severity is advantageously determined by the weight ratio of propane:propene ($R.I._3$) in the gaseous phase, it may also be measured by the analogous ratios of butanes:butenes, pentanes:pentenes ($R.I._5$), or the average of total reactor effluent alkanes:alkenes in the $C_3$-$C_5$ range. Accordingly, the product C5 ratio may be a preferred measure of reaction severity conditions, especially with mixed aliphatic feedstock containing $C_3$-$C_4$ alkanes.

This technique is particularly useful for operation with a fluidized catalytic cracking (FCC) unit to increase overall production of liquid product in fuel gas limited petroleum refineries. Light olefins and some of the light paraffins, such as those in FCC light gas, can be converted to valuable $C_5$+ hydrocarbon product in a fluid-bed reactor containing a zeolite catalyst. In addition to $C_2$-$C_4$ olefin upgrading, the load to the refinery fuel gas plant is decreased considerably.

The use of fluidized bed catalysis permits the conversion system to be operated at low pressure drop. Another important advantage is the close temperature control that is made possible by turbulent regime operation, wherein the uniformity of conversion temperature can be maintained within close tolerances, often less than 10° C. Except for a small zone adjacent the bottom gas inlet, the midpoint measurement is representative of the entire bed, due to the thorough mixing achieved.

In a typical process, the olefinic feedstock is converted in a catalytic reactor under oligomerization conditions and moderate pressure (ie-400 to 2500 kPa) to produce a predominantly liquid product consisting essentially of $C_5$+ hydrocarbons rich in gasoline-range olefins and essentially free of aromatics.

Referring now to FIG. 2, feed gas rich in lower olefins passes under pressure through conduit 210, with the main flow being directed through the bottom inlet of reactor vessel 220 for distribution through grid plate 222 into the fluidization zone 224. Here the feed gas contacts the turbulent bed of finely divided catalyst particles. Reactor vessel 220 is shown provided with heat exchange tubes 226, which may be arranged as several separate heat exchange tube bundles so that temperature control can be separately exercised over different portions of the fluid catalyst bed. The bottoms of the tubes are spaced above feed distributor grid 222 sufficiently to be free of jet action by the charged feed through the small diameter holes in the grid. Alternatively, reaction heat can be partially or completely removed by using cold feed. Baffles may be added to control radial and axial mixing. Although depicted without baffles, the vertical reaction zone can contain open end tubes above the grid for maintaining hydraulic constraints, as disclosed in U.S. Pat. No. 4,251,484 (Daviduk and Haddad). Heat released from the reaction can be controlled by adjusting feed temperature in a known manner.

Catalyst outlet means 228 is provided for withdrawing catalyst from above bed 224 and passed for catalyst regeneration in vessel 230 via control valve 229. The partially deactivated catalyst is oxidatively regenerated by controlled contact with air or other regeneration gas at elevated temperature in a fluidized regeneration zone to remove carbonaceous deposits and restore acid acitivity. The catalyst particles are entrained in a lift gas and transported via riser tube 232 to a top portion of vessel 230. Air is distributed at the bottom of the bed to effect fluidization, with oxidation byproducts being carried out of the regeneration zone through cyclone separator 234, which returns any entrained solids to the bed. Flue gas is withdrawn via top conduit 236 for disposal; however, a portion of the flue gas may be recirculated via heat exchanger 238, separator 240, and compressor 242 for return to the vessel with fresh oxidation gas via line 244 and as lift gas for the catalyst in riser 232.

Regenerated catalyst is passed to the main reactor 220 through conduit 246 provided with flow control valve 248. The regenerated catalyst may be lifted to the catalyst bed with pressurized feed gas through catalyst return riser conduit 250. Since the amount of regenerated catalyst passed to the reactor is relatively small, the temperature of the regenerated catalyst does not upset the temperature constraints of the reactor operations in significant amount. A series of sequentially connected cyclone separators 252, 254 are provided with diplegs 252A, 254A to return any entrained catalyst fines to the lower bed. These separators are positioned in an upper portion of the reactor vessel comprising dispersed catalyst phase 224. Filters, such as sintered metal plate filters, can be used alone or in conjunction with cyclones.

The product effluent separated from catalyst particles in the cyclone separating system is then withdrawn from the reactor vessel 220 through top gas outlet means 256. The recovered hydrocarbon product comprising $C_5$+ olefins and/or aromatics, paraffins and naphthenes is thereafter processed as required to provide a desired gasoline or higher boiling product.

Under optimized process conditions the turbulent bed has a superficial vapor velocity of about 0.3 to 2 meters per second (m/sec). At higher velocities entrainment of fine particles may become excessive and beyond about 3 m/sec the entire bed may be transported out of the reaction zone. At lower velocities, the formation of large bubbles or gas voids can be detrimental to conversion. Even fine particles cannot be maintained effectively in a turbulent bed below about 0.1 m/sec.

A convenient measure of turbulent fluidization is the bed density. A typical turbulent bed has an operating density of about 100 to 500 kg/m$^3$, preferrably about 300 to 500 kg/m$^3$, measured at the bottom of the reaction zone, becoming less dense toward the top of the reaction zone, due to pressure drop and particle size differentiation. The weight hourly space velocity and uniform contact provides a close control of contact time between vapor and solid phases, typically about 3 to 30 seconds.

Several useful parameters contribute to fluidization in the turbulent regime in accordance with the process of the present invention. When employing a ZSM-5 type zeolite catalyst in fine powder form such a catalyst should comprise the zeolite suitably bound or impregnated on a suitable support with a solid density (weight of a representative individual particle divided by its apparent "outside" volume) in the range from 0.6–2 g/cc, preferably 0.9–1.6 g/cc. The catalyst particles can be in a wide range of particle sizes up to about 250 microns, with an average particle size between about 20 and 100 microns, preferably in the range of 10–150 microns and with the average particle size between 40 and 80 microns. When these solid particles are placed in a fluidized bed where the superficial fluid velocity is 0.3–2 m/s, operation in the turbulent regime is obtained. The velocity specified here is for an operation at a total reactor pressure of about 400 to 2500 kPa. Those skilled in the art will appreciate that at higher pressures, a lower gas velocity may be employed to ensure operation in the turbulent fluidization regime. The reactor can assume any technically feasible configuration, but several important criteria should be considered. The bed of catalyst in the reactor can be at least about 5–20 meters in height, preferably about 9 meters.

The following example tabulates typical FCC light gas oligomerization reactor feed and effluent compositions and shows process conditions for a particular case in which the reactor temperature is controlled at 400° C. The reactor may be heat balanced by controlled preheating of the feed to about 135° C. The preferred catalyst is H-ZSM-5 (25 wt%) with particle distribution as described above for turbulent bed operation.

TABLE 1

| Composition, wt. % | Olig. Reactor Gas Feed | FCC Lift Recycle Gas |
|---|---|---|
| $C_2$ | — | 1 |
| $C_2$= | 5 | — |
| $C_3$ | 10 | 21 |
| $C_3$= | 21 | 3 |
| $iC_4$ | 15 | 31 |
| $nC_4$ | 4 | 11 |
| $C_4$= | 26 | 5 |
| other $C_2$− | 19 | 28 |
| Product gasoline: $C_5$+, 97 R + O; 81 M + O | | 0 |
| Reactor Conditions | | |
| Temperature, °C. | 400 | |
| Pressure | 1200 kPa | |
| Olefin WHSV (based on total cat. wt.) | 0.4 | |

An overall material balance of the integrated FCC-upgrading system, based on 100 parts by weight of vacuum gas oil feedstock, provides 94.1 parts of FCC product to the main fractionator, including 73.9 parts $C_5$+ FCC liquid product and 18.8 parts of $C_4$- product gas from the USGP. From the FCC separation units 20.2 parts of olefinic gas, rich in ethene, propene and butenes pass to the catalytic oligomerizaton unit to yield an additional 6.9 parts of $C_5$+ gasoline product, 6.1 parts of light gas product (eg-LPG and fuel gas), and 7.2 parts of $C_4$- recycle gas for use as lift gas in the FCC reactor. The FCC separator units provide about 57% gasoline product, 34% LCO and 9%HFO liquid cracking products. The FCC gasoline includes C5-C9 hydrocarbons having octane ratings of 93 R+O and 81 M+O.

While the invention has been shown by describing preferred embodiments of the process, there is no intent to limit the inventive concept, except as set forth in the following claims.

What is claimed is:

1. A process for upgrading light olefinic crackate gas from a fluidized catalytic cracking unit having a riser reactor for contacting hot solid cracking catalyst with a heavy hydrocarbon feedstock, said light crackate gas containing ethene and propene, comprising the steps of:

reacting said light olefinic gas in contact with a fluidized bed of acid medium pore zeolite catalyst particles under oligomerization/aromatization conditions to produce a hydrocarbon effluent stream rich in $C_5$+hydrocarbons and a byproduct light gas rich in $C_1$-$C_4$ saturated hydrocarbons;

separating the oligomerization reaction effluent stream to provide a second light gas stream containing predominantly $C_3$-$C_4$ alkanes and a condensed liquid hydrocarbon product stream; and recycling at least a portion of the second gas stream to the fluidized catalytic cracking unit as a lift gas for fluidizing solid cracking catalyst particles in a lower riser portion of said cracking unit.

2. The process of claim 1 further comprising the steps of fractionating fluid catalytic cracking gas oil crackate in a fluid catalytic cracking main fractionation column and unsaturated gas plant to provide liquid cracking products and an olefinic feedstream for catalytic upgrading.

3. The process of claim 1 wherein the feed comprises a petroleum oil fraction at a feed temperature of about 150° C. to 375° C.; the lift gas is provided at a rate of about one to ten parts by weight per 100 parts of heavy oil feed; and the hot regenerated catalyst is passed from the regenerator vessel at about 650° C. to 725° C.

4. In a fluid catalytic cracking process comprising admixing a hydrocarbon oil feed with hot regenerated catalyst in a bottom portion of a reactor riser with a light hydrocarbon lift gas, passing the mixture of the hydrocarbon oil feedstock, catalyst and lift gas through the riser, thereby volatilizing the oil feed and effecting cracking thereof at the process temperature under endothermic process conditions and deactivating the catalyst by deposition of carbonaceous deposits thereon, separating the deactivated catalyst from the cracked hydrocarbonaceous feed, passing the deactivated catalyst to a regenerator vessel wherein the carbonaceous deposits are removed from the deactivated catalyst under exothermic process conditions by means of a regenerating medium introduced into the regenerator vessel, and passing the regenerated hot catalyst substantially above process cracking temperature to the bottom section of the reactor riser; the improvement comprising separating and recovering cracked liquid hydrocarbons in a main fractionator to separate effluent from catalytic cracking of hydrocarbon feedstock to provide liquid cracking product and a light gas stream comprising $C_2$-$C_4$ olefinic and paraffinic gases;

contacting the olefin-containing gases in an olefin upgrading reactor with a fluidized bed of medium pore zeolite oligomerization catalyst particles under oligomerization reaction conditions to convert said olefins to gasoline range hydrocarbons and a $C_4$- byproduct gas stream rich in saturated hydrocarbons; and passing at least a portion of said byproduct saturated gas stream to the bottom of the cracking reactor riser as a lift gas.

5. An improved process according to claim 4 for converting light olefinic cracking gas to heavier hydrocarbons rich in C5+ aliphatics, comprising the steps of maintaining an oligomerization reactor containing a fluidized bed of zeolite catalyst particles in a low severity reactor bed at oligomerization temperature;

passing hot olefinic cracking gas upwardly through the fluidized catalyst bed in a single pass at reaction severity conditions sufficient to upgrade at least 75 wt% of the lower olefins to heavier olefins in the C5-C9 range; and recovering fluidized catalyst reactor effluent containing a major amount of $C_5$+ hydrocarbons, less than 1 wt% aromatics and a minor amount of C4- hydrocarbons.

6. The process of claim 5 wherein fluidized oligomerization catalyst has an apparent particle density of about 0.9 to 1.6 g/cm$^3$ and a size range of about 1 to 150 microns, average catalyst particle size of about 20 to 100 microns, and containing about 10 to 25 weight percent of fine particles having a particle size less than 32 microns.

7. The process of claim 5 wherein the oligomerization catalyst has an acid cracking alpha value of about 2 to 50, based on total reactor fluidized catalyst weight.

8. The process of claim 5 wherein the oligomerization catalyst consists essentially of a medium pore pentasil zeolite having an acid cracking alpha value of about 0.1 to 20 and average particle size of about 20 to 100 microns; fluidized bed reactor catalyst inventory includes at least 10 weight percent fine particles having a particle size less than 32 microns; and wherein said catalyst particles comprise about 5 to 95 weight percent XSM-5 mettalosilicate zeolite having a crystal size of about 0.02–2 microns.

* * * * *

UNITED STATES PATENT AND TRADEMARK OFFICE

CERTIFICATE OF CORRECTION

PATENT NO. : 4,966,680

DATED : October 30, 1990

INVENTOR(S) : A.A. Avidan et al.

It is certified that error appears in the above-identified patent and that said Letters Patent is hereby corrected as shown below:

Col. 14, claim 8, line 19, change " XSM-5" to --ZSM-5--.

Signed and Sealed this

Twenty-third Day of June, 1992

*Attest:*

DOUGLAS B. COMER

*Attesting Officer*

*Acting Commissioner of Patents and Trademarks*